US005769288A

United States Patent [19]

Berglund

[11] Patent Number: 5,769,288

[45] Date of Patent: Jun. 23, 1998

[54] LAUNDERED SHIRT STABILIZER

[76] Inventor: Stephen E. Berglund, 5128 N. Palm Ave., Fresno, Calif. 93704

[21] Appl. No.: 804,748

[22] Filed: Feb. 21, 1997

Related U.S. Application Data

[63] Continuation-in-part of Ser. No. 497,607, Jun. 30, 1995, Pat. No. 5,605,261.

[51] Int. Cl.[6] ..... D06C 15/00

[52] U.S. Cl. ..... 223/84; 223/83

[58] Field of Search ..... 223/84, 83, 82, 223/81, 52.1, 52.2, 52.3, 52.4, 72; 24/41.1

[56] References Cited

U.S. PATENT DOCUMENTS

| | | | |
|---|---|---|---|
| 2,022,401 | 11/1935 | Brooks . | |
| 2,420,162 | 5/1947 | Baker . | |
| 2,864,540 | 12/1958 | Kass . | |
| 3,865,286 | 2/1975 | Tiss . | |
| 4,798,293 | 1/1989 | Carstens . | |
| 5,269,691 | 12/1993 | Waldman | 434/429 |

FOREIGN PATENT DOCUMENTS

| | | | |
|---|---|---|---|
| 714251 | 10/1962 | Canada | 24/41 |
| 1426657 | 3/1934 | France . | |
| 405771 | 2/1934 | United Kingdom . | |

*Primary Examiner*—Bibhu Mohanty
*Attorney, Agent, or Firm*—Mark D. Miller

[57] ABSTRACT

A convenient disposable flat collar blank having an arcuate upper portion attached to an enlarged lower portion for keeping a freshly laundered shirt in a desired configuration, avoiding wrinkles and/or preventing creases. The back surface of the blank bears a pressure sensitive adhesive. A removable backing material is provided to cover the adhesive until the blank is put into use. The upper arcuate portion defines two elongated fingers for adhesive attachment to the neckband of a shirt under the collar in alignment with the seam of the neck of the shirt. The lower portion is adhesively engaged with the shirt over the uppermost region of the front placket, usually covering over the top button, with room for a display. An optional sleeve attachment may also be provided which includes a second arcuate blank, without disk, having pressure sensitive adhesive on one for adhesive attachment to the insides of the open cuffs of a freshly laundered shirt to hold the cuffs, and hence the sleeves, of the shirt together to avoid unnecessary creasing or wrinkles. An alternate or additional key-shaped cuff piece is also available for use with long sleeve shirts having French or double cuffs.

4 Claims, 4 Drawing Sheets

LAUNDERED SHIRT STABILIZER

This application is a CIP of Ser. No. 497,607, filed on Jun. 30, 1995, now U.S. Pat. No. 5,605,261.

BACKGROUND OF THE INVENTION

1. Field of the Invention

The present invention relates to shirts, and in particular to a disposable adhesive collar and cuff attachment employed to retain laundered shirts in a desired configuration after laundering and until they are worn.

2. Description of the Prior Art

Different methods have been employed in shirt laundering to help stabilize a freshly laundered shirt in order to maintain its crisp, pressed appearance and avoid creases and wrinkles. Among currently employed methods are straight or safety pins, metal or plastic clips, folded cardboard pieces, staples and nylon threads. These devices are attached to the collar and/or sleeve cuffs of the shirt in order to keep the shirt from opening or inadvertently falling from a support hanger. Metal components such as pins, clips or staples suffer from the serious drawback of possibly discoloring the shirt from rust if they become wet or damp. Pins and staples can leave holes in the shirt, and have sharp ends which must be handled carefully in order to avoid puncture wounds. Plastic clips do not attach as firmly as pins or staples, but although less hazardous they have a greater tendency to become loosened or detached, or to break.

At least two different types of cardboard shirt collar stays are known in the art. The first is in the form of a rigid rectangular collar shaping piece having a generally T-shaped upper section hingedly attached at the bottom of the "T" to a generally U-shaped lower section. In use, the horizontal top of the "T" is folded over the top button into the inside of a shirt collar, and the two vertical sides of the "U" are placed under the shirt collar on either side. Unfortunately, such a shaping piece, even if made of sturdy cardboard, is susceptible to easy dislodgement, as well as tearing along the folded hinges. It is not likely to stay in place or provide the necessary support if there is any substantial movement of the shirt itself. No support for the sleeves is provided at all.

The other known cardboard collar stay is described in U.S. Pat. No. 3,865,286. It consists of a flat generally H-shaped piece having V-shaped upper and lower notches, with adhesive on one of the flat surfaces covered by a removable backing. After removing the backing, the lower notch is engaged with the uppermost shirt button and the upper legs are attached via adhesive to the undersides of the collar lapels. This collar stay requires that the shirt have a lapel and an upper button in close proximity with the collar, and that such button on the shirt be buttoned closed. Many tuxedo shirts have small collar lapels, or none at all, making this type of stay unusable. Many other shirts have no upper button, and for those that do, it is time consuming and cumbersome to engage such a button before attaching such a collar stay. Also, such a stay will move around the button. Finally, this collar stay provides only a very small area for engagement to the collar itself which may easily be dislodged. No support for the sleeves is provided at all.

SUMMARY OF THE INVENTION

The present invention overcomes each of the above described drawbacks by providing a convenient disposable flat collar attachment, or blank, having an arcuate upper portion attached to an enlarged lower portion. Both portions have a back surface bearing a pressure sensitive adhesive. A removable backing material is provided to cover the adhesive until the invention is put into use. The upper arcuate portion defines two elongated fingers which are placed in adhesive engagement with the neckband of the shirt in alignment with the seam of the neck of the shirt. The lower portion is adhesively engaged with the shirt over the uppermost region of the front placket, usually covering over the top button. The lower portion provides support for the fingers which hold the shirt collar in place.

An optional sleeve attachment may also be provided which includes a second arcuate blank, without the lower portion, having pressure sensitive adhesive on one side with removable backing. The sleeve attachment is designed for adhesive attachment to the insides of the open cuffs of a freshly laundered long sleeve shirt to hold the cuffs, and hence the sleeves, of the shirt together to avoid unnecessary creasing or wrinkles. The sleeve attachment may be used for the same purpose when attached to the lower sleeve edges of short sleeve shirts.

An alternate or additional cuff piece is also available for use with long sleeve shirts having French or double cuffs. The cuff piece has a shape resembling a key and includes a widened bow at one end and a pointed blade at the other end. Pressure sensitive adhesive is provided on one side with removable backing. The cuff piece is designed such that after removal of the backing, its pointed blade may be inserted through the cuff holes of the French sleeve cuffs. The cuffs themselves are folded as for wearing prior to insertion. The bow is too large to fit through the button holes, and stops the full advancement of the blade. When the blade is fully extended, the exposed adhesive surface of the bow is then adhered to the outer surface of the cuff. The protruding end of the blade is bent and also adhered to the cuff, thereby holding the French cuff of the shirt in place in much the same manner as an ordinary cuff link. The cuff piece may be used independently of, or in combination with either or both of the collar piece and sleeve attachment described above.

The front surface of the lower portion of the collar attachment, the entire front surface of the sleeve attachment and the front of the cuff piece are available for printing appropriate use instructions or advertising material.

It is therefore a primary object of the present invention to provide a convenient disposable adhesive collar attachment for keeping the collar of a freshly laundered shirt in a desired configuration.

It is a further important object of the present invention to provide the combination of an adhesive shirt collar attachment and adhesive shirt sleeve cuff attachment for holding the collar and cuffs of a freshly laundered shirt in a desired configuration.

It is a further important object of the present invention to provide a convenient disposable shirt collar support having adhesive on one side for temporary attachment to a freshly laundered shirt which leaves no adhesive residue when removed.

It is a further object of the present invention to provide a disposable adhesive shirt collar support having elongated fingers for attachment to a significant portion of the shirt neckband in order to hold the collar thereof in a desired configuration.

It is a further important object of the present invention to provide a disposable adhesive shirt collar support which helps prevent creasing, wrinkling or collapsing of the collar of a freshly laundered shirt.

It is a further important object of the present invention to provide the combination of a disposable adhesive shirt collar support and disposable adhesive shirt sleeve retainer which helps prevent creasing, wrinkling or collapsing of the collar, sleeves and cuffs of a freshly laundered shirt.

It is a further important object of the present invention to provide the combination of a disposable shirt collar support and disposable shirt sleeve retainer, each part having adhesive on one side for temporary attachment to a freshly laundered shirt which leaves no adhesive residue when removed.

It is a further object of the present invention to provide the combination of a disposable adhesive shirt collar support and disposable French cuff retainer to help prevent creasing, wrinkling or collapsing of the collar, and cuffs of a freshly laundered shirt.

It is a further object of the present invention to provide a disposable adhesive cuff piece for holding the French cuffs of a shirt in place in much the same manner as an ordinary cuff link.

Additional objects of the invention will be apparent from the detailed descriptions and the claims herein.

DETAILED DESCRIPTION OF THE DRAWINGS

Figure 2:
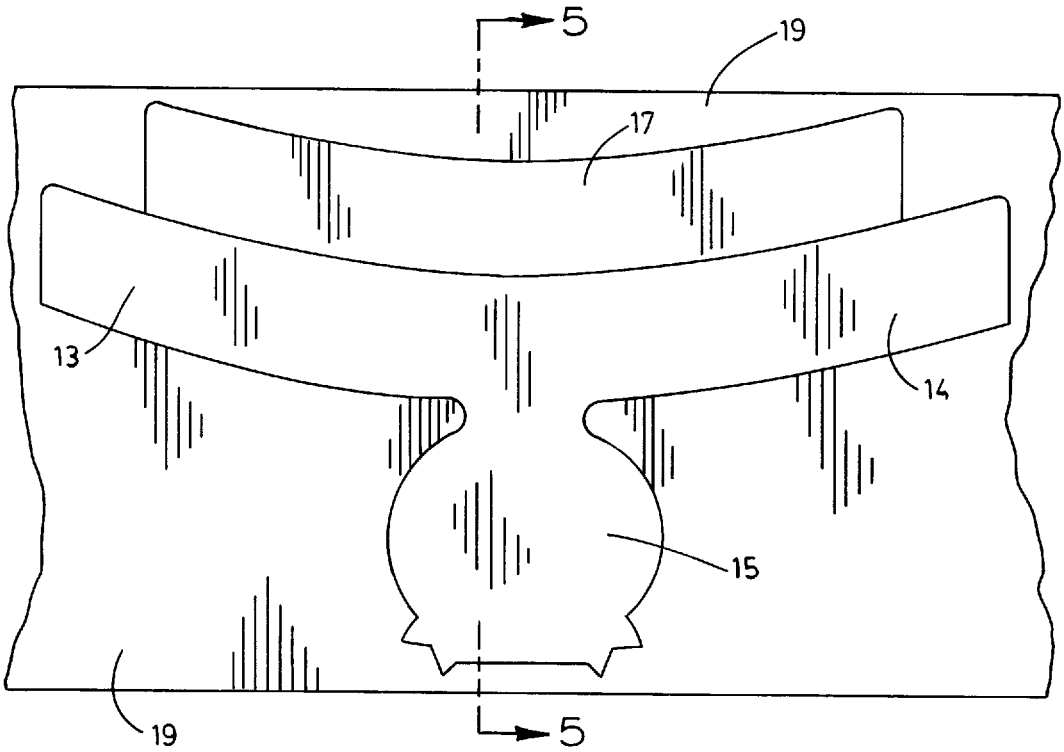
FIG. 2 is a front view of the collar and sleeve parts of the present invention attached to a protective backing.
Figure 3:
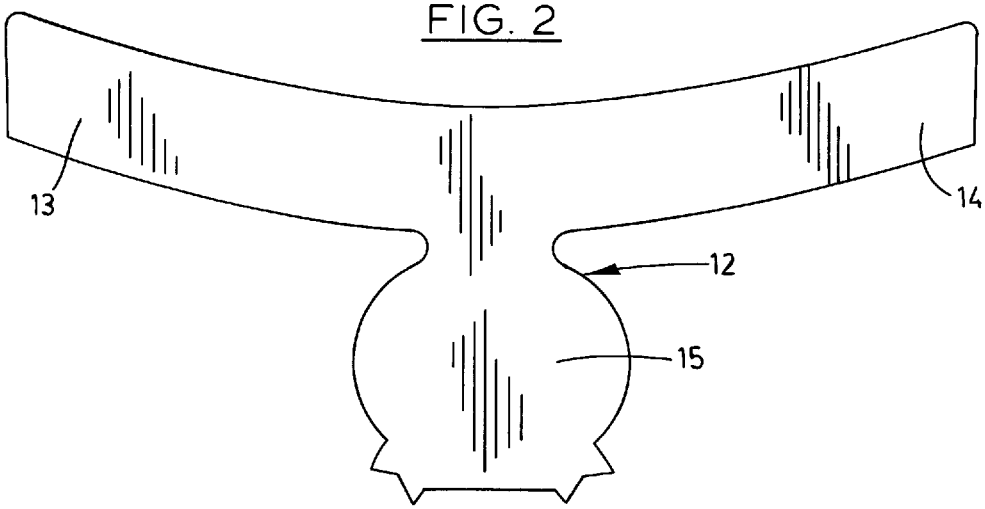
FIG. 3 is a front view of the collar attachment of the present invention.
Figure 4:
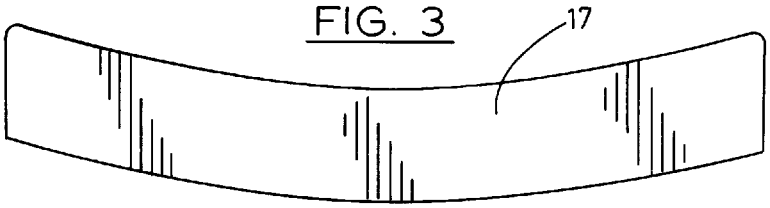
FIG. 4 is a front view of the sleeve attachment of the present invention.
Figure 5:
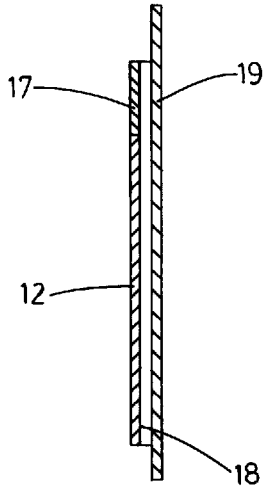
FIG. 5 is a cross sectional side view along line 5—5 of FIG. 2.

Referring to the drawings wherein like reference characters designate like or corresponding parts throughout the several views, and referring particularly to FIG. 3 it is seen that the invention includes a Y-shaped blank, generally 12, which includes an arcuate upper portion having left 13 and right 14 fingers. The fingers are attached to a lower region 15. The back surface of blank 12 is provided with an adhesive layer 18 having a protective backing 19 behind it (see FIGS. 2 and 5).

Figure 6:
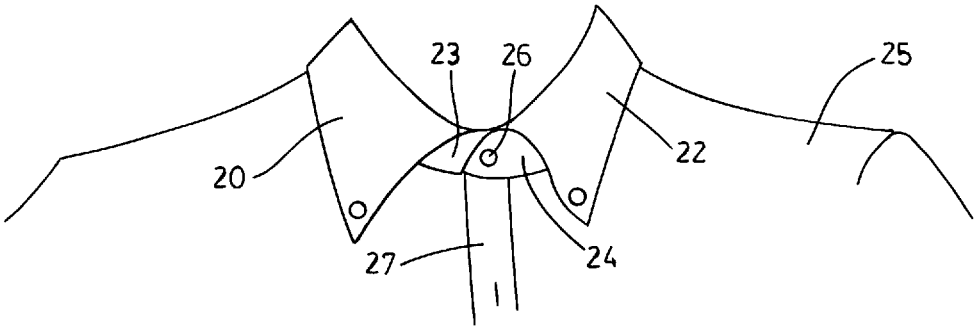
FIG. 6 is a front view of a typical shirt collar and neckband before application of the present invention.
Figure 9:
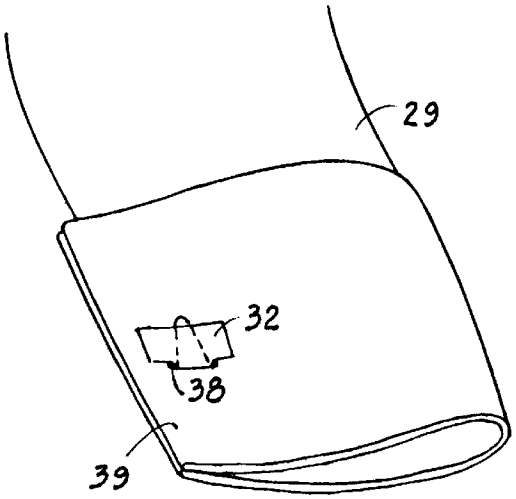
FIG. 9 is a perspective view of the cuff piece of the present invention showing its attachment to a French cuff sleeve.
Figure 10:
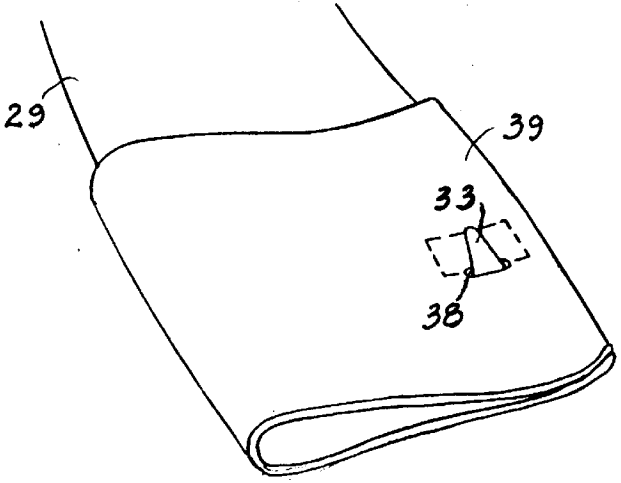
FIG. 10 is an opposite perspective view of the cuff piece of the present invention showing its attachment to a French cuff sleeve.
Figure 8:
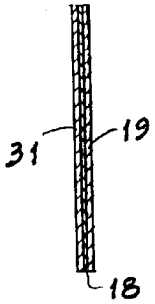
FIG. 8 is a cross-sectional view of the cuff piece along line 8—8 of FIG. 7.
Figure 7:
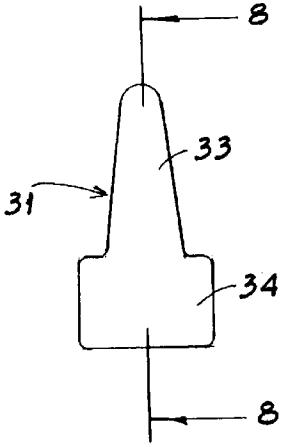
FIG. 7 is a front view of the cuff piece of the present invention.

In use, the protective backing 19 is removed from blank 12 exposing the adhesive layer 18. Left finger 13 is applied to the left side neckband 23 of a freshly laundered shirt 25 in line with the seam of the neck line. Similarly, right finger 14 is applied to the right side neckband 24 of shirt 25 in line with the right side seam. (Neither finger is attached to the underside of the collar 20, 22). Region 15 is adhered over the upper portion of the shirt front placket 27 and over top button 26 (see FIGS. 1 and 6). Button 26 may or may not be closed before blank 12 is applied to the shirt. Fingers 13 and 14 are elongated in order to provide adhesion and support to nearly half of the diameter of the neck line. The large size of region 15 provides further support to fingers 13 and 14 as well as an exposed area for the printing of information, instructions or advertising.

Figure 1:
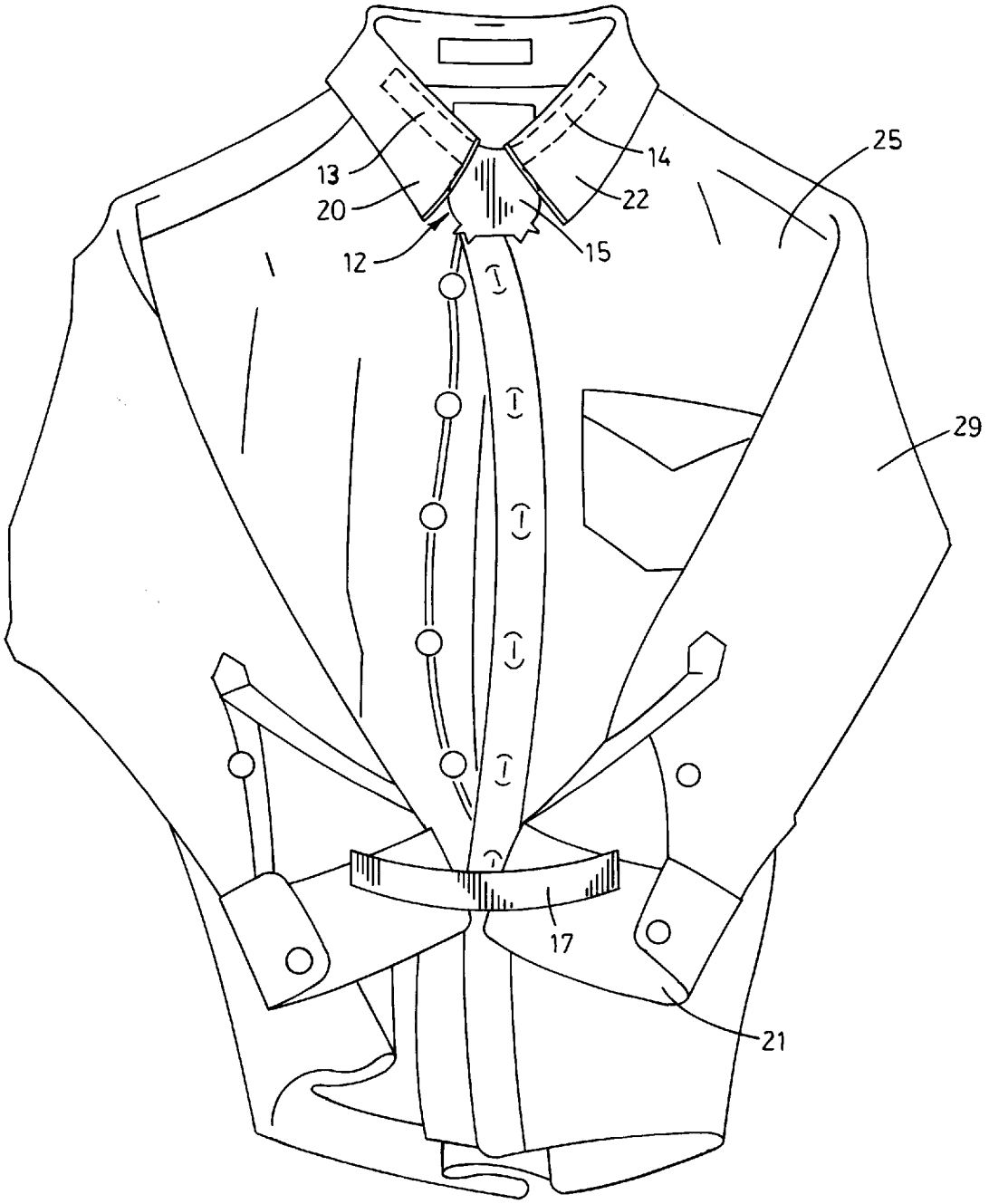
FIG. 1 is a perspective front view of a freshly laundered shirt upon which the collar and sleeve parts of the present invention have been attached.

An optional sleeve retainer 17 is provided for holding the sleeves 29 or sleeve cuffs 21 together as shown in FIG. 1. In short sleeved shirts, the sleeves 29 themselves are held together. As with the collar blank 12, retainer 17 has an adhesive layer 18 on the back surface which is protected by covering 19 until used.

A French or double cuff retaining piece 31 is also provided (see FIGS. 7–10). Piece 31 is in the shape of a key having a wider bow area 32 and a pointed blade 33. Bow area 32 may be in any appropriate shape, including round, oval, square, triangular, rectangular, hexagonal, octagonal, etc. so long as it is wider than the button holes 38 of the French cuffs 39 on the shirt. The embodiment shown in FIG. 7 has a rectangular shape. Retaining cuff piece 31 is provided with an adhesive layer 18 and may be removed from backing 19 in the same way as the collar and sleeve pieces.

In use, the cuff retaining piece 31 is removed from backing 19. The French cuffs 39 of the shirt are folded as for use. The blade 33 is inserted through the buttonholes 38 of the cuffs 39 until advancement is stopped by bow 32. The adhesive side 18 of bow 32 is then folded back against the adjacent surface of cuff 39 (see FIG. 9) so as to adhere thereto. The protruding adhesive side 18 of blade 33 is also folded back so as to adhere to the adjacent surface of cuff 39 (see FIG. 10). This placement holds the French cuffs in place in much the same way as an ordinary cuff link.

DESCRIPTION OF THE PREFERRED EMBODIMENTS

In the preferred embodiment, the blank of the present invention is made of cardboard, paperboard, fiberboard, plastic or other sturdy but flexible material. The adhesive 18 should be of a type that adheres to fabric, but will not leave a residue thereon after removal. Backing 19 may be wax paper or other suitable material. Information, instructions and/or advertising may be printed on the front surfaces of blank 12 (especially region 15). Elongated fingers 13 and 14 should each be at least two inches (2") and preferably over three inches (3") in length.

In the alternative embodiment, sleeve and/or cuff retainers 17 and 31 are provided. They should be made of the same material as blank 12, and can be manufactured along with blank 12 and attached to the same backing 19 as shown in FIG. 2. The shape of the bow 32 of piece 31 can be round, oval, square, triangular, rectangular, hexagonal, octagonal, etc. so long as it is wider than the button holes 38 of the French cuffs 39 on the shirt.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A set of disposable adhesive shirt attachments comprising:

a first stiff yieldably flexible substantially Y-shaped flat blank having a front and back surface, an arcuate upper portion defining two generally horizontal elongated members centrally attached to a larger lower portion, said back surface being coated with a pressure sensitive adhesive material, whereby the two elongated members are adhesively attached to a shirt neckband underneath the collar and the lower portion is attached over the upper part of the front placket of said shirt in order to maintain said shirt in a desired configuration until it is worn;

a second stiff yieldably flexible flat generally horizontal arcuate blank, said second blank having a front and back surface with pressure sensitive adhesive material on the back surface, whereby said second blank is attached to the sleeves of the shirt in order to prevent the sleeves from wrinkling; and a third stiff yieldably flexible flat blank having a pointed blade attached to a wider bow, said third blank having a front and back surface with pressure sensitive adhesive material on the back surface for attachment through the button holes of a double cuff sleeve in order to hold the double cuffs in place.

2. A disposable shirt stabilizer kit comprising, in combination:

a first stiff yieldably flexible substantially Y-shaped flat paperboard blank having a front and back surface, an arcuate upper portion defining two generally horizontal elongated members centrally attached to a larger lower portion, said back surface being coated with a pressure sensitive adhesive material, wherein the two elongated members are adhesively attached to a shirt neckband underneath the collar and the lower portion is attached over the upper part of the front placket of said shirt in order to maintain said shirt collar in a desired configuration until it is worn; and a second stiff yieldably flexible flat blank having a pointed blade attached to a wider bow, said second blank having a front and back surface with pressure sensitive adhesive material on the back surface for attachment through the button holes of a shirt sleeve cuff in order to hold the cuff in place.

3. In combination, a garment sleeve with cuff button holes and a disposable stabilizer therefor comprising a stiff yieldably flexible flat blank having a pointed blade attached to a wider bow, said blank having a front and back surface with pressure sensitive adhesive material on the back surface for attachment to the cuff by inserting the blade through the cuff button holes in order to hold the cuff in place.

4. The combination of a garment with button holes and a disposable stabilizer therefore, said stabilizer comprising a stiff yieldably flexible flat blank having a pointed blade attached to a wider bow, said blank having a front and back surface with pressure sensitive adhesive material on the back surface for attachment to the garment by insertion of the blade through a button hole of the garment and application of pressure to removably adhere the material to the garment.

* * * * *